US009523332B2

(12) United States Patent
Kobayashi

(10) Patent No.: US 9,523,332 B2
(45) Date of Patent: Dec. 20, 2016

(54) VALVE DEVICE

(71) Applicant: DENSO CORPORATION, Kariya, Aichi-pref. (JP)

(72) Inventor: Takashi Kobayashi, Okazaki (JP)

(73) Assignee: DENSO CORPORATION, Kariya (JP)

( * ) Notice: Subject to any disclaimer, the term of this patent is extended or adjusted under 35 U.S.C. 154(b) by 914 days.

(21) Appl. No.: 13/860,942

(22) Filed: Apr. 11, 2013

(65) Prior Publication Data

US 2013/0313460 A1 Nov. 28, 2013

(30) Foreign Application Priority Data

May 28, 2012 (JP) ..... 2012-120838

(51) Int. Cl.
*F02M 25/07* (2006.01)

(52) U.S. Cl.
CPC ..... *F02M 26/50* (2016.02); *F02M 26/52* (2016.02); *F02M 26/54* (2016.02); *F02M 26/70* (2016.02); *F02M 26/65* (2016.02)

(58) Field of Classification Search
CPC ..... F02M 26/52; F02M 26/53; F02M 26/54; F02M 26/65; F02M 26/70; F02M 26/72; F02M 25/077; F02M 25/07771; F02M 25/07772; F02M 25/07773; F02M 25/0787; F02M 25/0793; F02D 9/08; F02D 9/10; F02D 9/1065; F02D 2011/102; F02D 2011/103; F02D 2011/104
See application file for complete search history.

(56) References Cited

U.S. PATENT DOCUMENTS 6,164,623 A * 12/2000 Ito ..... F02D 9/1065 123/337
2001/0000574 A1* 5/2001 Wayama ..... F02D 9/1065 123/337
2005/0183705 A1 8/2005 Nanba et al.
2007/0240676 A1* 10/2007 Sasaki ..... F02D 9/04 123/337
2007/0240677 A1 10/2007 Sasaki
2012/0325189 A1* 12/2012 Takezoe ..... F02D 41/0077 123/568.21

FOREIGN PATENT DOCUMENTS

JP 2007-032618 2/2007

OTHER PUBLICATIONS

Machine Translation of JP 2007-032618.*
Office Action (2 pages) dated Apr. 15, 2014, issued in corresponding Japanese Application No. 2012-120838 and English translation (2 pages).

* cited by examiner

*Primary Examiner* — Joseph Dallo
*Assistant Examiner* — Anthony L Bacon
(74) *Attorney, Agent, or Firm* — Nixon & Vanderhye P.C.

(57) ABSTRACT

A valve device includes a valve, an actuator actuating the valve, a control unit controlling an opening degree of the valve, a return spring biasing the valve only in a valve-closing direction, and a mechanical stopper controlling a rotating limit of the valve in the valve-closing direction. The valve is defined to rotate on a plus side from the full-close position in a valve-opening direction and to rotate on a minus side from the full-close position in a direction opposite from the valve-opening direction. The mechanical stopper stops the valve at a stopper position which is set on the minus side from the full-close position, and a predetermined overshoot range is defined between the full-close position and the stopper position.

10 Claims, 3 Drawing Sheets

VALVE DEVICE

CROSS REFERENCE TO RELATED APPLICATION

This application is based on Japanese Patent Application No. 2012-120838 filed on May 28, 2012, the disclosure of which is incorporated herein by reference in its entirety.

TECHNICAL FIELD

The present disclosure relates to a valve device.

BACKGROUND

The valve device includes a valve, for example, having a butterfly shape, and a passage is fully closed by the valve when the valve is located to be perpendicular to the passage at a full-close position. When the valve is rotated in a valve-opening direction from the full-close position, the valve is defined to be located on a plus side from the full-close position. When the valve is rotated in a direction opposite from the valve-opening direction from the full-close position, the valve is defined to be located on a minus side from the full-close position.

Conventionally, an exhaust gas recirculation (EGR) unit is known as a valve device. JP-A-2005-233063 (US 2005/0183705) describes such an EGR unit in which deposit is removed by controlling an actuator of an EGR valve.

When a predetermined condition is met, for example, when an engine is stopped, the actuator actuates the valve to rotate alternately from the plus side to the minus side with respect to the full-close position.

If deposit gets cold while the engine is stopped, the valve may get stuck by cold deposit, and torque generated when the valve is opened may get increased. However, an area around the valve is cleaned by an alternate rotating movement of the valve, because the deposit can be removed.

To practice the deposit removing control, the valve needs to rotate toward the minus side, so a range of rotating of the valve needs to be extended to the minus side, minus ten degree (−10°), for example.

In a conventional technique, a double-spring is applied as a return spring, and the valve is controlled to rotate back to the full-close position. The double-spring includes a first spring and a second spring. The first spring controls the valve to rotate back to the full-close position from the plus side, and the second spring controls the valve to rotate back to the full-close position from the minus side.

The double-spring has a complicated structure in which the first and second springs have opposite winding directions, so producing cost is increased.

Furthermore, the double-spring has three positions to be fixed, so the number of assembly process is increased. The three positions are a free end of the first spring, a free end of the second spring, and a middle hook placed at a connection section of the first spring and the second spring.

On the other hand, when the amount of the deposit is smaller, the deposit removing control is unnecessary. In this case, the valve does not need to rotate toward the minus side.

When the valve rotates from the plus side to the full-close position, it is necessary to reduce rotating speed of the valve to prevent the valve from colliding with a stopper. In other words, speed reducing control of the valve is necessary. In this case, a response to revolve the valve to the full-close position is required to be raised.

SUMMARY

It is an object of the present disclosure to provide a valve device in which a valve has high responsivity when the valve is fully closed.

According to an example of the present disclosure, a valve device includes a valve, an actuator, a control unit, a return spring, and a mechanical stopper. The valve rotates to open and close a fluid passage in which exhaust gas passes. The actuator actuates the valve to open and close. The control unit controls an opening degree of the valve within a range between a full-close position and a full-open position by controlling an actuating of the actuator. The return spring, constructed with a single spring, biases the valve only in a valve-closing direction. The mechanical stopper controls a rotating limit of the valve in the valve-closing direction. The valve is defined to rotate on a plus side from the full-close position in a valve-opening direction and to rotate on a minus side from the full-close position in a direction opposite from the valve-opening direction. The mechanical stopper stops the valve at a stopper position which is set on the minus side from the full-close position. A predetermined overshoot range is defined between the full-close position and the stopper position.

The return spring is the single spring, which biases the valve only in the valve-closing direction.

The control unit controls the valve opening only between the full-close position and the full-open position. When the actuator is stopped in a case where an ignition switch is turned off, the biasing force of the return spring rotates the valve on the minus side from the full-close position, and the valve is stopped at the stopper position.

The valve is restricted from colliding with the stopper in the overshoot range when the valve is rotated by the actuator from the plus side toward the full-close position. Therefore, it is unnecessary to reduce the rotating speed of the valve before colliding with the stopper, and the responsivity can be raised when the valve is fully closed. Thus, the responsivity can be kept high when the single spring is adopted as the return spring of the actuator.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
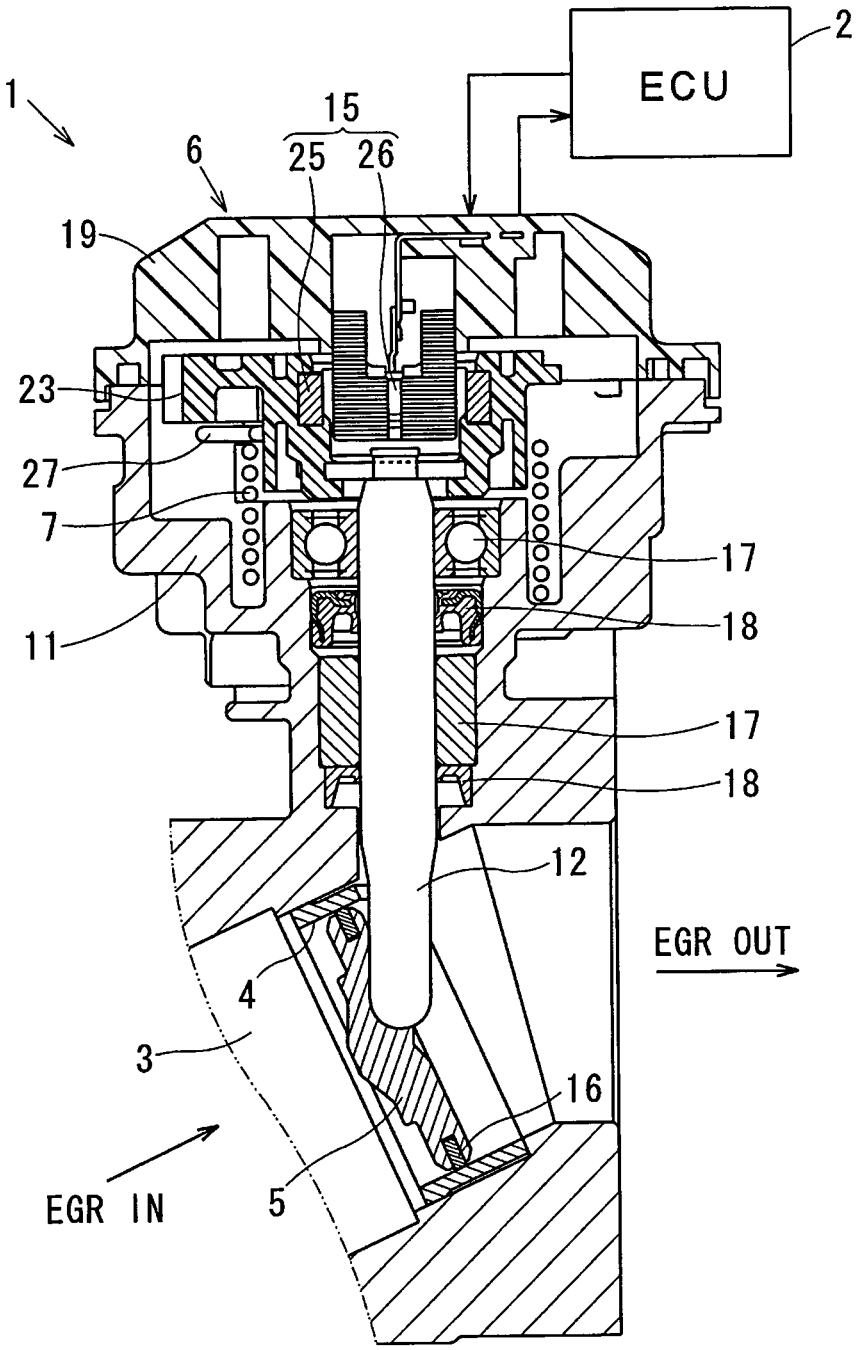
FIG. 1 is a schematic sectional view illustrating a valve device according to an embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

An exhaust gas recirculation (EGR) unit, which is an example of a valve device, circulates a portion of exhaust gas exhausted from an engine back to an intake side of the engine. The EGR unit has an EGR valve 1 and an engine control unit (ECU) 2, which is an example of a control unit, controlling the EGR valve 1.

The EGR valve 1 has a valve 5 having a butterfly shape, and an electric actuator 6, that is an example of an actuator, actuates the valve 5. The valve 5 rotates inside a nozzle 4 which is fixed to an EGR passage 3, which is an example of a fluid passage, and opens and closes the EGR passage 3.

The EGR valve 1 also has a return spring 7 made from a single spring, and a mechanical stopper 8. The mechanical stopper 8 mechanically controls a rotating limit of the valve 5 in a valve-closing direction.

Figure 2:
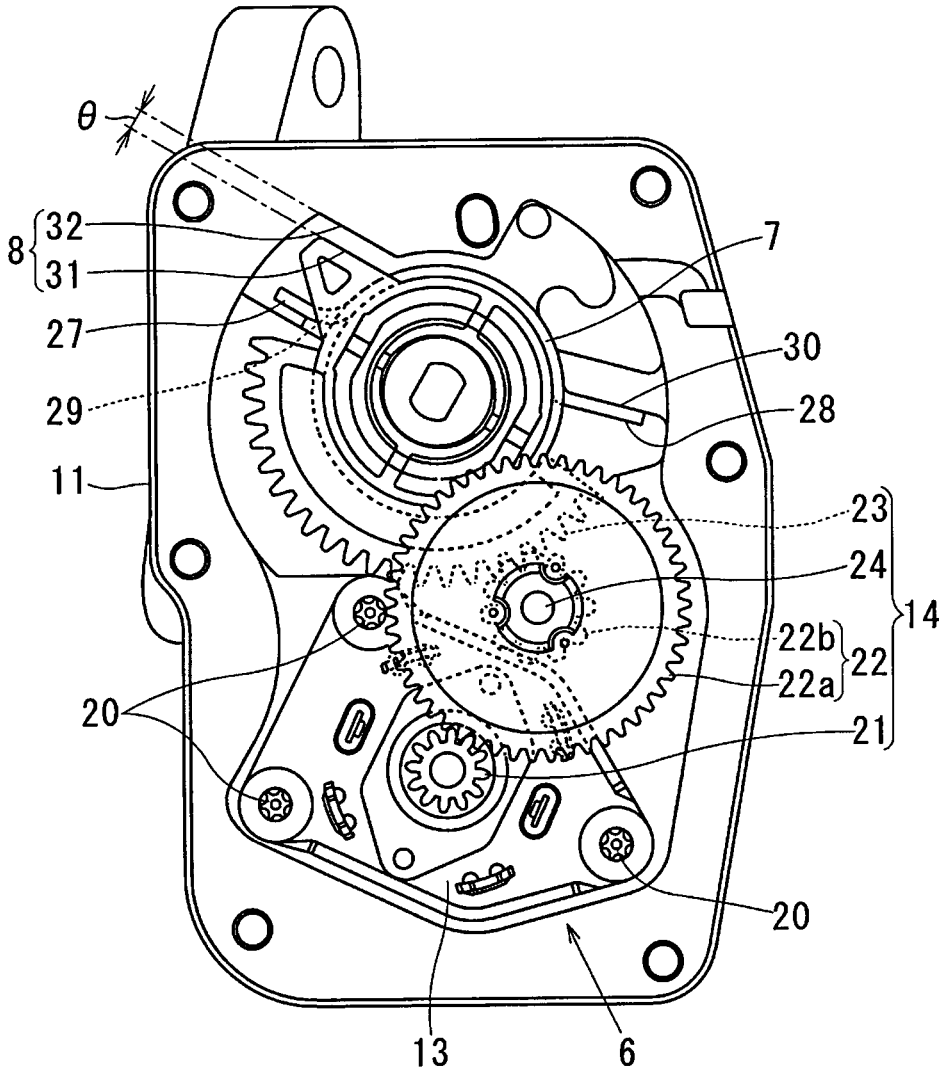
FIG. 2 is a schematic view illustrating an electric actuator of the valve device without a cover.
Figure 4:
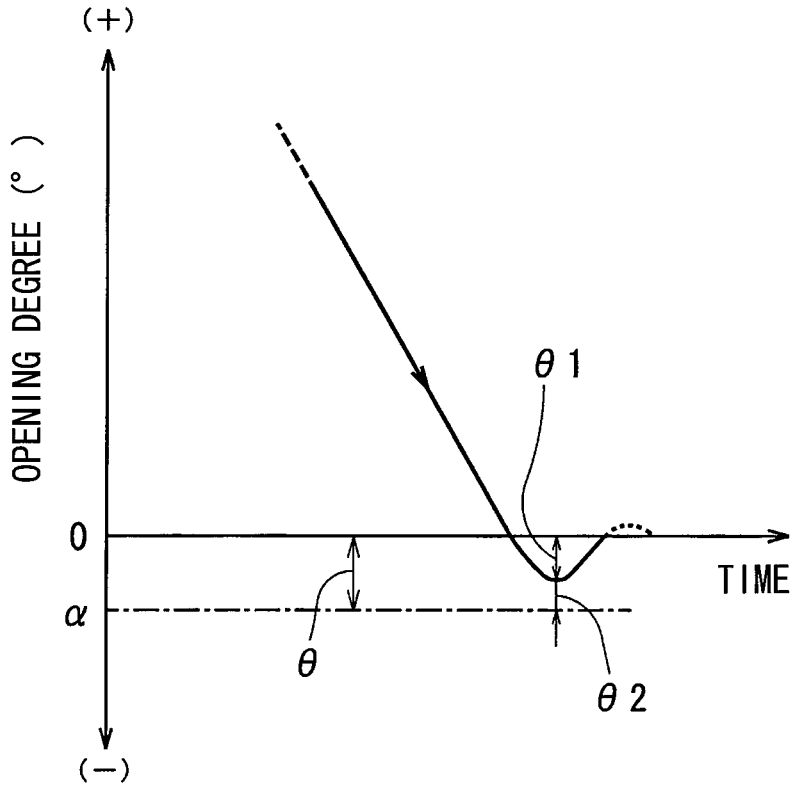
FIG. 4 is an explanatory graph illustrating a relationship between an undershoot angle and a margin angle.

The mechanical stopper 8 has a stopper position $\alpha$ for the valve 5, and the stopper position $\alpha$ is set on the minus side from the full-close position. A predetermined overshoot range $\theta$ is defined between the full-close position and the stopper position $\alpha$. The overshoot range $\theta$ is shown in FIGS. 2 and 4.

The ECU 2 controls the opening degree of the valve 5 between the full-close position and the full-open position via the electric actuator 6. In other words, the ECU 2 does not set a target opening degree on the minus side from the full-close position.

When an ignition switch is turned off, for example when an engine stops such that the ECU 2 stops energizing the electric actuator 6, the valve 5 rotates toward the minus side only by the spring force of the return spring 7, and stops at the stopper position $\alpha$ due to the mechanical stopper 8.

The present disclosure is applied to the EGR unit, but is not limited to be applied to the EGR unit.

The EGR unit is a well-known technique to mix an EGR gas, which is an incombustible gas, into intake air by circulating a portion of exhaust gas emitted from an engine back to an intake side of the engine as the EGR gas.

The EGR unit has at least the EGR valve 1 which is controlled by the ECU 2. The EGR valve 1 is controlled to open and close, and the opening degree of the EGR passage 3 is controlled by the EGR valve 1. The EGR passage 3 circulates the portion of exhaust gas emitted from the engine back to the intake side of the engine.

An EGR valve for high-pressure and an EGR valve for low-pressure may be applicable to the EGR valve 1. The EGR valve for high-pressure circulates the EGR gas back to a high negative-pressure producing area in an air-intake passage, which is downstream of a throttle valve in the intake air flow. The EGR valve for low-pressure circulates the EGR gas back to a low negative-pressure producing area in the air-intake passage, which is upstream of the throttle valve. For example, when the vehicle is equipped with a turbocharger, the EGR valve for low-pressure is located upstream of a compressor in the intake air flow.

An aspect of the EGR valve 1 will be described with reference to FIGS. 1 and 2. Although upside in FIG. 1 will be expressed as upper and downside in FIG. 1 will be expressed as lower hereafter, those words are used just for expression and should not be limited.

The EGR valve 1 includes a housing 11 defining a part of the EGR passage 3, the valve 5 placed in the EGR passage 3, a shaft 12 supporting the valve 5, and the electric actuator 6 giving torque to the shaft 12.

The electric actuator 6 includes an electric motor 13, a gear reducer 14, the return spring 7, and a rotation angle sensor 15. The electric motor 13 is electrified to produce torque. The gear reducer 14 amplifies the torque of the electric motor 13 and transmits the amplified torque to the shaft 12. The return spring 7 biases the valve 5 through the shaft 12 toward only in the valve closing direction. The rotation angle sensor 15 detects the opening degree of the valve 5.

The housing 11 is die-casting aluminum alloy. The EGR passage 3 is placed inside the housing 11, and the nozzle 4 having a cylindrical shape is supported to the inner wall of the EGR passage 3. The nozzle 4 is made of stainless steel, which is a material having high heat resistance and high corrosion resistance, and an inner side of the nozzle 4 not touching the housing 11 defines a part of the inner wall of the EGR passage 3 in the housing 11.

The valve 5 has a nearly circular disk shape, and opens and closes the EGR passage 3 with rotating of the shaft 12. Also, the valve 5 is a butterfly valve changing the opening area of the EGR passage 3 in the nozzle 4, so the valve 5 controls the amount of the EGR gas circulating back to an intake passage depending on the opening degree.

An outer edge of the valve 5 has a seal ring 16 to clear the gap between the valve 5 and the inner circumference wall of the nozzle 4.

The shaft 12 supports the valve 5 to rotate in the EGR passage 3. In the embodiment, the shaft 12 supports the valve 5 from one side and the like, and the axis of the shaft 12 is inclined to a radial direction of the valve 5 at the full-close position.

The valve 5 is fixed to a bottom end of the shaft 12, and the valve 5 revolves with the shaft 12 integrally. The valve 5 is connected to the shaft 12 by welding, screws, and the like.

The shaft 12 is supported to rotate by two bearings 17 located above the EGR passage 3 in the housing 11. The bearing 17 may be made of a rolling-element bearing such as ball bearing or roller bearing, or a slide bearing such as metal bearing. The bearings 17 are fixed into bearing holding holes by coupling techniques such as press fitting and the like, and supports the shaft 12 to revolve.

A sealing member 18 is placed between the housing 11 and the shaft 12 to prevent EGR gas from leaking.

The electric actuator 6 is jointed to the housing 11, and a gear cover 19 is attached to an upper part of the housing 11 to be removable by a fastening portion such as screw.

The housing 11 has a motor holding space which holds the electric motor 13 inside. The gear reducer 14 and the return spring 7 are supported in a space formed between the housing 11 and the gear cover 19.

The electric motor 13 is a familiar direct-current motor. When the energization direction is changed, the electric motor 13 changes rotating direction and produces torque depending on the energization amount. The electric motor 13 is inserted to the motor holding space formed in the housing 11, and then, fixed to the housing 11 by a fastening member 20 such as screw.

As shown in FIG. 2, the gear reducer 14 has a motor gear 21, a middle gear 22, and a final gear 23. The motor gear 21 is a pinion gear, and rotates with the electric motor 13 integrally. The middle gear 22 is actuated to rotate by the motor gear 21. The final gear 23 is a valve gear actuated to rotate by the middle gear 22 and rotates with the shaft 12 integrally. The gear reducer 14 reduces a rotating speed of the electric motor 13, and transmits the speed-reduced rotation of the electric motor 13 to the shaft 12.

The motor gear 21 is an external gear having a relatively small diameter, and fixed to an output shaft of the electric motor 13.

The middle gear 22 is a double-gear in which a gear 22*a* having a large diameter and a gear 22*b* having a small diameter are held coaxially. The middle gear 22 is supported to rotate by a support shaft 24 supported by the housing 11 and the gear cover 19. The gear 22*a* and the motor gear 21 are kept engaged, and the gear 22*b* and the final gear 23 are kept engaged.

The final gear 23 is an external gear having a relatively large diameter, into which a connecting plate is inserted. The connecting plate is fixed to an end part of the shaft 12 by caulking. The final gear 23 has engaging external teeth only in a range in response to the rotation of the valve 5. The rotating speed of the electric motor 13 is reduced and amplified in following order; the motor gear 21, the gear 22*a*, and the gear 22*b*, and the amplified rotation torque is transmitted from the final gear 23 to the shaft 12.

The rotation angle sensor 15 is a non-contact position sensor detecting the opening degree of the valve 5 by detecting a rotation angle of the shaft 12, and outputs an opening degree signal corresponding to the opening degree of the valve 5.

Specifically, as shown in FIG. 1, the rotation angle sensor 15 is a magnetic sensor having a magnetic circuit 25 and a magnetic detecting portion 26. The rotation angle sensor 15 detects relative rotation of the magnetic circuit 25 and the magnetic detecting portion 26 without contact with each other. The magnetic circuit 25 has a nearly cylindrical shape. The magnetic circuit 25 is inserted into the final gear 23, and rotates with the shaft 12 integrally. The magnetic detecting portion 26 is attached to the gear cover 19 without contact to the magnetic circuit 25, and produces a voltage signal, which is an output signal of a Hall integrated circuit (IC), to the ECU 2.

The ECU 2 is a familiar electric control unit mounting a microcomputer which conducts a feedback control for electric motor 13, in a manner that the opening degree of the valve 5 detected by the rotation angle sensor 15 agrees with a target degree calculated in accordance with the engine operating condition such as rotating speed or accelerator opening degree.

The feedback control is a familiar control technique that regulates the opening degree of the valve 5 back to a predetermined target value using, for example, proportional integral (PI) control or proportional integral derivative (PID) control.

According to the embodiment, the EGR valve 1 has the return spring 7 biasing the valve 5 in the valve closing direction only.

Figure 3:
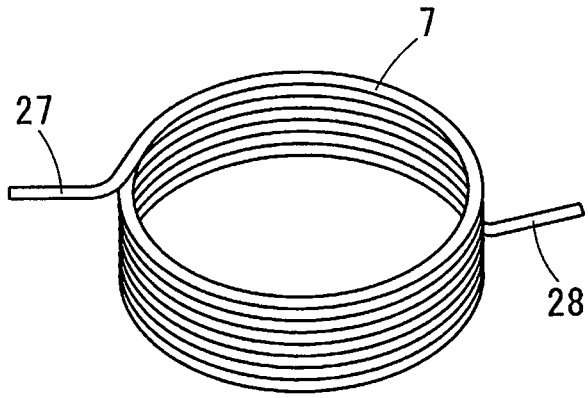
FIG. 3 is a perspective view illustrating a return spring of the valve device.

As shown in FIG. 3, the return spring 7 is a single spring constructed with a coil spring. As shown in FIG. 1, the return spring 7 is wound around the shaft 12 coaxially in one direction.

When the return spring 7 is attached between the housing 11 and the final gear 23, the return spring 7 has a compressed force. As shown in FIGS. 2 and 3, an end of the return spring 7 has an upper hook 27, and the other end of the return spring 7 has an under hook 28. Both of the upper hook 27 and the under hook 28 are projecting or protruding outward in a radial direction of the return spring 7. Specifically, the upper hook 27 is attached to press against an upper hook connecting part 29 of the final gear 23, and the under hook 28 is attached to press against an under hook connecting part 30 of the housing 11, thereby the return spring 7 produces the compressed force.

The EGR valve 1 has the mechanical stopper 8 keeping the valve 5 at a predetermined position, that is the stopper position $\alpha$, while the electric actuator 6 stops.

The mechanical stopper 8 mechanically regulates the rotation limit of the valve 5 in the valve closing direction, and is defined by a contact section at which the final gear 23 of the gear reducer 14 and the housing 11 holding the electric actuator 6 contact with each other.

An aspect of the mechanical stopper 8 will be described below.

As shown in FIG. 2, the mechanical stopper 8 has a stopper lever 31 placed on the final gear 23 and projecting outward in a radial direction, and a bump surface 32 defined by an inner wall of the housing 11 that holds the final gear 23. When the valve 5 rotates toward the minus side from the full-close position, the stopper lever 31 knocks the bump surface 32, therefore the valve 5 stops at the stopper position $\alpha$.

The stopper position $\alpha$ is set on the minus side from the full-close position, and an overshoot range $\theta$ is predetermined between the full-close position and the stopper position $\alpha$.

On the other hand, the ECU 2 controls the opening degree of the valve 5 only between the full-close position and the full-open position via the electric actuator 6.

Accordingly, the ECU 2 predetermines the opening degree of the valve 5 between the full-close position and the full-open position, and does not set the target opening degree on the minus side.

In the embodiment, as shown in FIG. 4, the overshoot range $\theta$ is a sum of an undershoot angle $\theta 1$ and a margin angle $\theta 2$.

The undershoot angle $\theta 1$ is an expected maximum undershoot amount. Specifically, the undershoot angle $\theta 1$ is a maximum angle of the valve 5 on the minus side overshooting the full-close position (that is 0° in FIG. 4) in a case where the ECU 2 operates the valve 5 to rotate from the open side to the full-close position with the feedback control.

The margin angle $\theta 2$ is set for restricting the stopper lever 31 from colliding with the bump surface 32 of the mechanical stopper 8 in a case where the opening degree of the valve 5 reaches the undershoot angle $\theta 1$. The margin angle $\theta 2$ also includes component tolerance.

The undershoot angle $\theta 1$ in the embodiment may be 3° as an example. The margin angle $\theta 2$ in the embodiment may be larger than or equal to 1° or 2°, as an example.

In the embodiment, a value of the overshoot range $\theta$ is determined so that the stopper position $\alpha$ falls within a dead zone.

The dead zone is a range of the opening degree of the valve 5 that keeps the EGR passage 3 closed by the seal ring 16 even when the opening degree of the valve 5 slightly changes around the full-close position.

More specifically, an outer edge of the valve 5 has the seal ring 16 to clear the gap between the valve 5 and the nozzle 4. The outer edge of the valve 5 has an annular groove over all the circumference, and the seal ring 16 is inserted into the annular groove.

The seal ring 16 is made of a wire rod formed into a ring shape. The wire rod is made of a metal material such as stainless steel and the like. For example, the wire rod has a square-shaped cross-section, which is planed off the corners. Because the seal ring 16 is made of the wire rod, the seal ring 16 has at least one separated part in the circumference direction. The seal ring 16 may be made of other materials such as resin material having high heat resistance, high oil resistance, and high wearing resistance.

The separated part of the seal ring 16 in the free state defines a slight gap in the circumference direction. The seal ring 16 shrinks when a perimeter of the seal ring 16 is pressed against the nozzle 4 at the full-close position.

Therefore, the seal ring 16 keeps the perimeter of the seal ring 16 touching an inner wall of the nozzle 4. When the valve 5 rotates within a predetermined range around the full-close position at which the opening degree is 0°, the structure of the seal ring 16 also keeps the EGR passage 3 substantially closed. Thus, the EGR passage 3 is kept closed regardless of rotating of the valve 5 in the dead zone.

In the embodiment, the dead zone will be defined by about ±5° from the full-close position (0°), for example.

Then, in the embodiment, the overshoot range θ is set into 5° to keep the EGR passage 3 closed practically even when the valve 5 stops rotating at the stopper position α.

Thus, in the embodiment, as an example, the undershoot angle θ1 is set to 3°, and the margin angle θ2 is set to 2°, so that the stopper position α is set within the dead zone.

According to the embodiment, when the electric actuator 6 actuates the valve 5 to rotate from the open side toward the full-close position, the stopper lever 31 is restricted from colliding with the bump surface 32 of the mechanical stopper 8 due to the overshoot range θ.

Specifically, in the case where the electric actuator 6 actuates the valve 5 to rotate toward the full-close position, when the valve 5 is rotated on the minus side by the undershoot angle θ1, the valve 5 is prevented from hitting the mechanical stopper 8 due to the overshoot range θ set by adding the margin angle θ2 to the undershoot angle θ1.

Accordingly, it is unnecessary for the ECU 2 to reduce rotating speed of the valve 5 before the mechanical stopper 8 works, and the valve 5 rotates quickly toward the full-close position from the open side. In other words, a closing responsiveness to a requirement for closing the valve 5 will be enhanced.

Thus, in the embodiment, when the single spring is adopted as the return spring 7 of the electric actuator 6, the cost of producing the EGR valve 1 can be reduced, and the closing responsiveness can be raised.

According to the embodiment, when the ignition switch is turned off, the valve 5 rotates toward the minus side only by the compressed force of the return spring 7, and stops at the stopper position α by knocking to the mechanical stopper 8. Specifically, the knocking is generated between the stopper lever 31 and the bump surface 32.

The knocking speed of the valve 5 (the stopper lever 31) relative to the mechanical stopper 8 (the bump surface 32) produced by only the compressed force of the return spring 7 is much slower than that produced by the electric actuator 6.

Accordingly, a breakage of the mechanical stopper 8 (the final gear 23) can be prevented, and reliability of the EGR valve 1 can be enhanced.

According to the embodiment, when the valve 5 stops at the stopper position α, the EGR passage 3 is kept closed practically because the stopper position α is set within the dead zone.

Accordingly, when the valve 5 is kept at the full-close position after the engine is started, a leak amount of the EGR gas may be reduced, and emission may be prevented to decline.

According to the embodiment, the valve 5 is returned to the full-close position by the biasing force of the return spring 7 in a case where the electric actuator 6 stops accidentally. Therefore, a combustion state of an engine can be kept better even if an unexpected abnormality happens.

When the amount of deposit adhering to a circumference of the valve 5 is smaller, the deposit removing control is unnecessary. In this case, the valve 5 does not need to rotate toward the minus side. In such a case, there is no necessity to adopt a double-spring. The return spring 7 is constructed by the single spring which has one winding direction and which biases the valve 5 to rotate only in the valve-closing direction. By adopting the single spring, structure and assembly of the return spring 7 may be simplified, and the producing cost may be decreased.

In the embodiment described above, although the stopper lever 31 is located to the final gear 23 as an example of the mechanical stopper 8, the position of the mechanical stopper 8 is not limited, while the stopper 8 mechanically regulates the rotating limit of the valve 5 in the valve-closing direction.

In the embodiment described above, the stopper position α may be located out of the dead zone. In this case, the stopper position α is located in a range where a predetermined leak acceptable value is secured.

In the embodiment described above, the electric actuator 6 may be replaced with other actuator that is controllable by the ECU 2, such as hydraulic actuator or negative pressure actuator.

In the embodiment described above, the present disclosure is applied to the EGR unit. The present disclosure may be applicable to other unit that includes a waste-gate valve or exhaust throttle valve which opens and closes a fluid passage in which exhaust gas passes.

Such changes and modifications are to be understood as being within the scope of the present disclosure as defined by the appended claims.

What is claimed is:

1. A valve device comprising:

a valve configured to rotate to open and close a fluid passage in which exhaust gas passes;

an actuator configured to actuate the valve to open and close;

a control unit configured to control an opening degree of the valve within a range between a full-close position and a full-open position by controlling actuation of the actuator;

a return spring, constructed with a single spring, biasing the valve only in a valve-closing direction; and a mechanical stopper configured to control a rotating limit of the valve in the valve-closing direction, wherein the valve is defined to rotate on a plus side from the full-close position in a valve-opening direction and to rotate on a minus side from the full-close position in a direction opposite from the valve-opening direction, the mechanical stopper is configured to stop the valve at a stopper position which is set on the minus side from the full-close position, and a predetermined overshoot range is defined between the full-close position and the stopper position, the valve at the full-close position is oriented to be perpendicular to an inner wall of the fluid passage, the control unit is configured so that when an ignition switch is on, the valve is controlled within the range between the fill-open position and the full-close position, and the control unit is configured so that when the ignition switch is off, the valve is rotated toward the minus side only by a spring force of the return spring, and is stopped and positioned on the minus side.

2. The valve device according to claim 1, wherein
the actuator has a rotation angle sensor configured to detect the opening degree of the valve,
the control unit is configured to conduct a feedback control to control the valve to have a target angle based on the opening degree detected by the rotation angle sensor,
the valve is defined to have a maximum angle on the minus side from the full-close position as an undershoot angle when the valve is operated to the full-close position from the plus side by the feedback control, and
the predetermined overshoot range is set by adding a margin angle to the undershoot angle.

3. The valve device according to claim 1, further comprising:
a seal ring mounted to an outer edge of the valve, wherein
the valve has a dead zone in which the fluid passage is kept closed by the seal ring even when the opening degree of the valve is varied, and
the stopper position is set within the dead zone.

4. The valve device according to claim 1, wherein
the actuator is an electric actuator having
an electric motor configured to produce a rotation torque by being energized, and
a gear reducer configured to amplify the rotation torque of the electric motor, and
the mechanical stopper is formed by a contact section at which a final gear of the gear reducer and a housing holding the electric actuator contact with each other.

5. The valve device according to claim 1, wherein
the valve device is an exhaust gas recirculation unit configured to circulate a portion of exhaust gas emitted from an engine back to an intake side of the engine.

6. The valve device according to claim 1, wherein
the actuator stops being energized when the ignition switch is turned off to stop an engine,
the mechanical stopper has a bump surface and a stopper lever which knocks the bump surface to stop the valve at the stopper position when the valve rotates toward the minus side from the full-close position, and
a clearance degree between the bump surface and the stopper lever is equal to the predetermined overshoot range.

7. The valve device according to claim 6, wherein
when the actuator stops being energized, the valve rotates toward the minus side only by the spring force of the return spring, and stops at the stopper position,
the valve is defined to have a maximum angle on the minus side from the full-close position as an undershoot angle when the valve is operated to the full-close position,
the predetermined overshoot range is set by adding a margin angle to the undershoot angle, and
a value of the predetermined overshoot range is set so that the stopper position falls within a dead zone in which the fluid passage is kept closed even when the opening degree of the valve is varied.

8. The valve device according to claim 1, wherein
the mechanical stopper has a bump surface and a stopper lever which contacts the bump surface to stop the valve at the stopper position when the valve rotates toward the minus side from the full-close position, and
a clearance degree between the bump surface and the stopper lever is equal to the predetermined overshoot range.

9. The valve device according to claim 8, wherein
when the actuator stops being energized, the valve rotates toward the minus side only by the spring force of the return spring, and stops at the stopper position,
the valve has an undershoot angle that is a maximum angle on the minus side from the full-close position when the valve is operated to the full-close position,
the predetermined overshoot range is set by adding a margin angle to the undershoot angle, and
a value of the predetermined overshoot range causes the stopper position to be within a dead zone in which the fluid passage is kept closed even when the opening degree of the valve is varied.

10. A valve device comprising:
a valve configured to rotate to open and close a fluid passage in which exhaust gas passes;
an actuator configured to actuate the valve to open and close;
a control unit configured to control an opening degree of the valve within a range between a full-close position and a full-open position by controlling actuation of the actuator;
a return mechanism configured so that the valve is biased only in a valve-closing direction throughout an extent that the valve can rotate; and
a mechanical stopper configured to control a rotating limit of the valve in the valve-closing direction, wherein the valve is defined to rotate on a plus side from the full-close position in a valve-opening direction and to rotate on a minus side from the full-close position in a direction opposite from the valve-opening direction,
the mechanical stopper is configured to stop the valve at a stopper position which is set on the minus side from the full-close position, and a predetermined overshoot range is defined between the full-close position and the stopper position,
the valve at the full-close position is oriented to be perpendicular to an inner wall of the fluid passage,
the control unit is configured so that when an ignition switch is on, the valve is controlled within the range between the full-open position and the full-close position, and
the control unit is configured so that when the ignition switch is off, the valve is rotated toward the minus side only by the return mechanism and is stopped and positioned on the minus side.

* * * * *